US005511734A

United States Patent [19]

Enger et al.

[11] Patent Number: 5,511,734

[45] Date of Patent: Apr. 30, 1996

[54] METHOD AND APPARATUS FOR SEVERING THE FREE YARN END OF A YARN RESERVE WINDING

[75] Inventors: Jürgen Enger; Hermann-Josef Vest, both of Mönchengladbach, Germany

[73] Assignee: W. Schlafhorst AG & Co., Moenchengladbach, Germany

[21] Appl. No.: 509,655

[22] Filed: Jul. 31, 1995

Related U.S. Application Data

[63] Continuation of Ser. No. 392,412, Feb. 22, 1995, abandoned, which is a continuation of Ser. No. 45,041, Apr. 7, 1993, abandoned.

[30] Foreign Application Priority Data

Apr. 8, 1992 [DE] Germany ..... 42 11 749.6

[51] Int. Cl.[6] ..... B65H 54/38; B65H 54/71

[52] U.S. Cl. ..... 242/18 PW; 242/19; 242/48

[58] Field of Search ..... 242/18 PW, 48, 242/49, 19

[56] References Cited

U.S. PATENT DOCUMENTS

| | | | |
|---|---|---|---|
| 2,800,290 | 7/1957 | Hess . | |
| 3,224,692 | 12/1965 | Nugent . | |
| 4,049,209 | 9/1977 | Bach et al. | 242/18 PW |
| 4,101,086 | 7/1978 | Thomas | 242/125.1 |
| 4,102,507 | 7/1978 | Hoffmann et al. | 242/18 PW |
| 4,195,788 | 1/1980 | Mizazaki et al. | 242/18 PW |
| 4,466,575 | 8/1984 | Husges et al. | 242/18 PW |
| 4,634,064 | 1/1987 | Burkhard et al. | 242/18 PW |
| 4,687,148 | 8/1987 | Schuller et al. | 242/18 PW |
| 4,948,057 | 8/1990 | Greis | 242/18 PW |
| 5,005,776 | 4/1991 | Schwarz | 242/18 PW |

FOREIGN PATENT DOCUMENTS

| | | | |
|---|---|---|---|
| 0148419 | 7/1985 | European Pat. Off. . | |
| 1275423 | 8/1968 | Germany . | |
| 2506291 | 8/1976 | Germany . | |
| 3344645 | 6/1985 | Germany . | |
| 3509154 | 9/1986 | Germany . | |
| 3733353 | 12/1988 | Germany . | |
| 12189 | of 1912 | United Kingdom | 242/19 |
| 720447 | 12/1954 | United Kingdom | 242/19 |

*Primary Examiner*—William Stryjewski

*Attorney, Agent, or Firm*—Herbert L. Lerner; Laurence A. Greenberg

[57] ABSTRACT

A method for winding a yarn reserve a tube of a bobbin before a yarn package is wound includes initially applying a piece of yarn on an end of a tube of a bobbin while leaving a free yarn end. The piece of yarn is covered and fixed in place with a small number of yarn windings of a yarn reserve. The free yarn end is severed on the tube between the yarn reserve and the tube end while the bobbin is rotating. An apparatus for winding a yarn reserve on a tube of a bobbin before a yarn package is wound includes a holder for a bobbin tube. A yarn transferring device delivers a yarn to the tube. A drive drives the tube while initially applying a piece of yarn on an end of the tube and leaving a free yarn end. A yarn guide lays the yarn on the tube and covers and fixes the piece of yarn in place with a small number of yarn windings of a yarn reserve. A yarn cutter trips a severing process by being fed toward the rotating tube and severs the free end of the yarn on the tube between the yarn reserve and the tube end.

10 Claims, 6 Drawing Sheets

FIG. 2
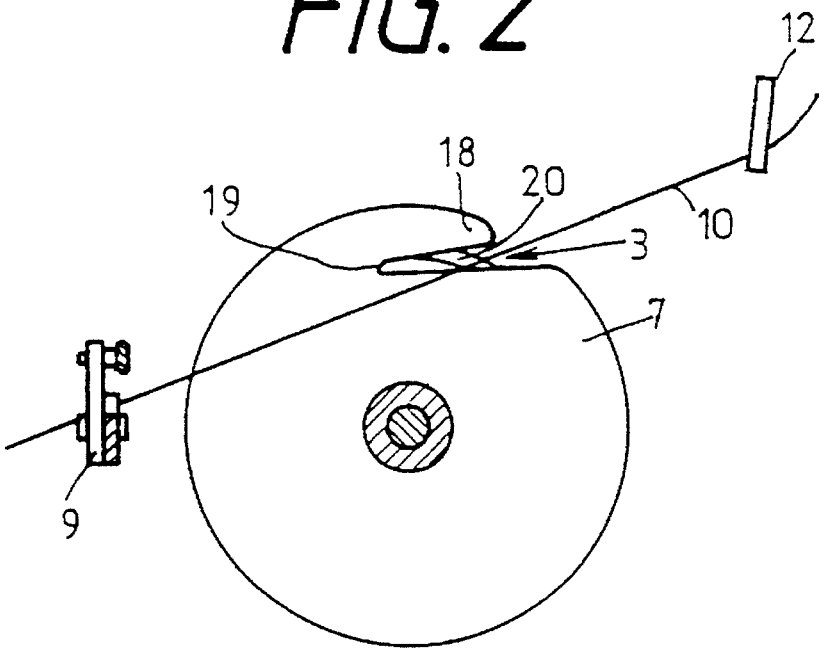
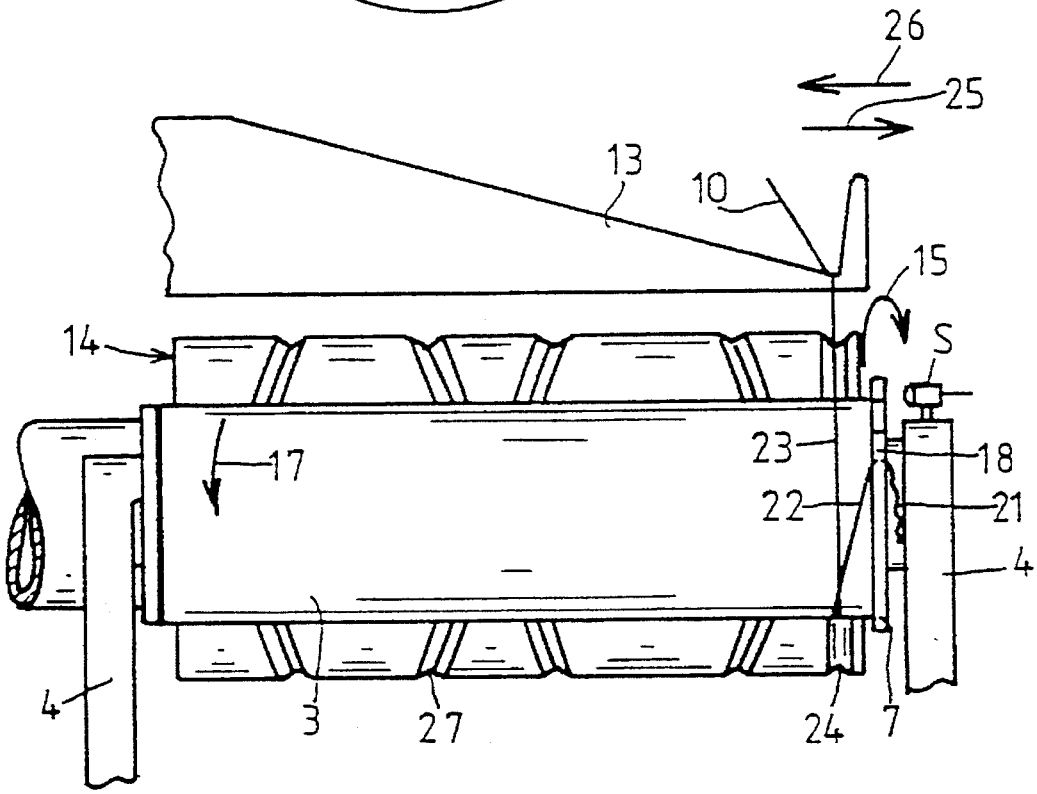
FIG. 3

FIG. 5
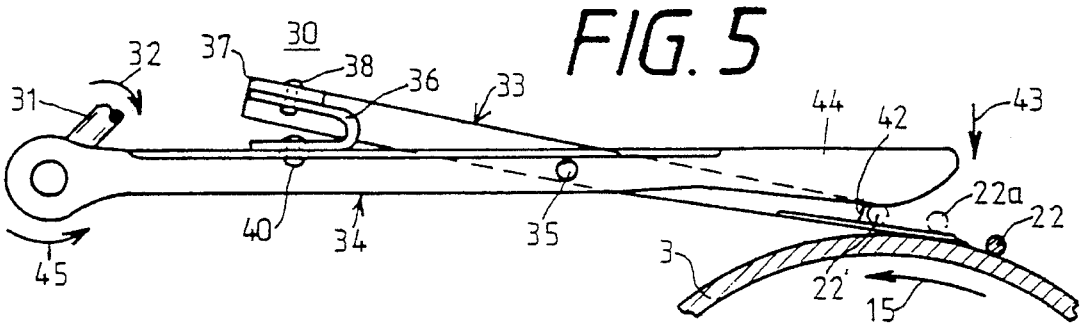
FIG. 5a
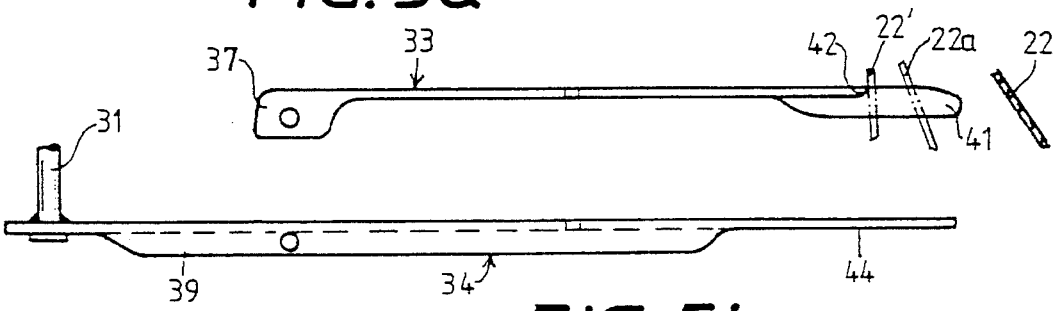
FIG. 5b
FIG. 9
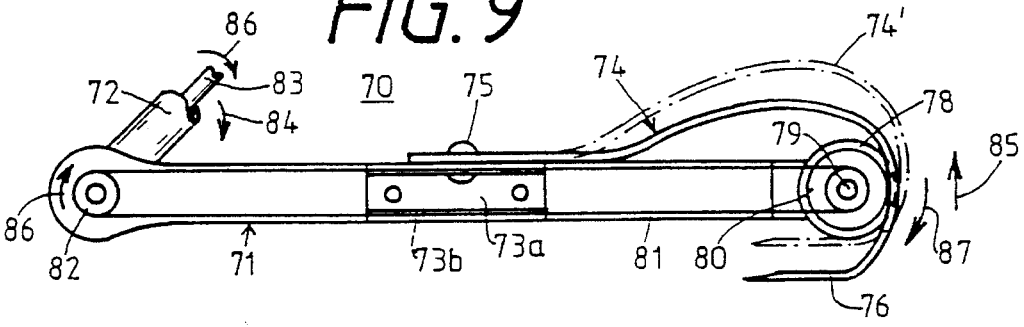
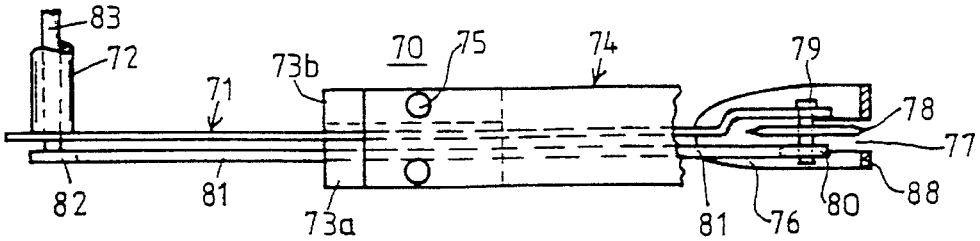
FIG. 9a

FIG. 8
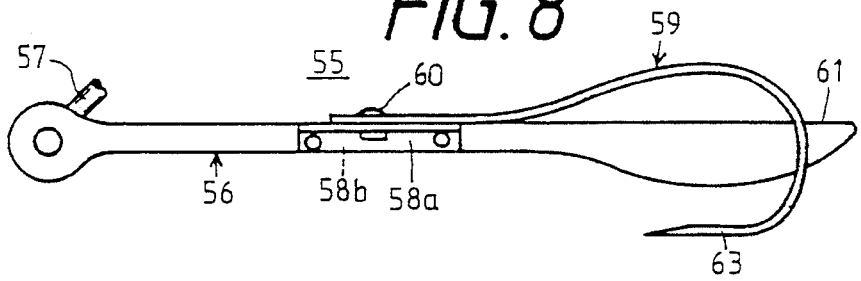
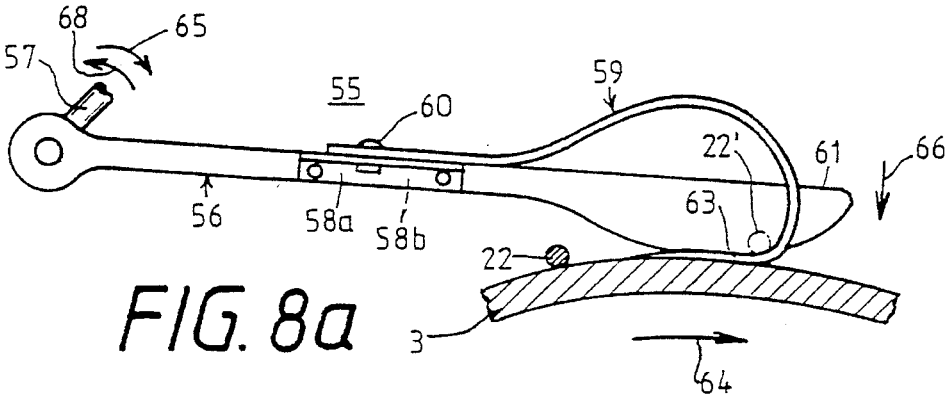
FIG. 8a
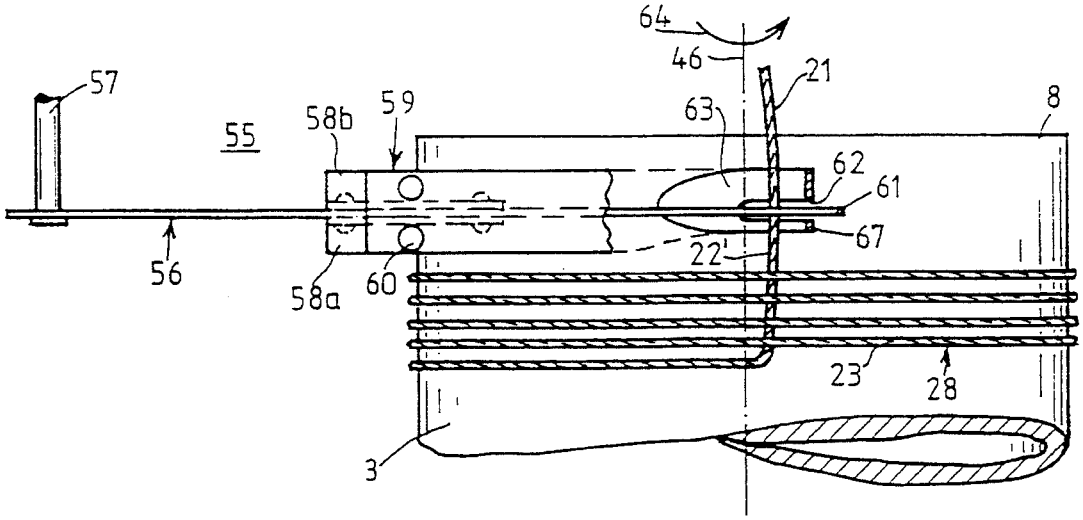
FIG. 8b

METHOD AND APPARATUS FOR SEVERING THE FREE YARN END OF A YARN RESERVE WINDING

This application is a continuation of application Ser. No. 08/045,041, filed Apr. 7, 1993, now abandoned.

BACKGROUND OF THE INVENTION

1. Field of the Invention

The invention relates to a method for winding a yarn reserve on the tube of a bobbin before the package is wound, by winding a small number of yarn windings on one end of the tube, with a piece of yarn applied first to the tube being covered and fixed in place by windings of the yarn reserve. The invention also relates to an apparatus for performing the method.

When cross-wound bobbins or cheeses are further processed, it is advantageous for the yarn end on the bobbin to be accessible. When the yarn is drawn from bobbins on creels, for instance, the yarn ends of a bobbin that is running empty can be spliced to the beginning of the yarn of a full bobbin which is to be unwound next. Bobbins can then pay out continuously one after the other. Furthermore, the freely accessible piece of yarn on the yarn reserve, that is the piece of yarn applied to the tube first, which is covered and fixed in place by the windings of the yarn reserve, must be readily accessible. In addition, the yarn must not be damaged or undergo any change in its structure, in order to avoid flaws in a fabric in later processing of the yarn.

DESCRIPTION OF THE RELATED ART

German Published, Non-Prosecuted Application DE 37 33 353 A1 discloses a method and an apparatus for producing a yarn reserve. First, the yarn supplied to a bobbin tube is aspirated into a suction nozzle, which is centrally located in the tube disk of the bobbin holder. The beginning of the yarn is held by the suction and is clamped in place between the tube edge and the tube disk when the tube is installed. Once the yarn reserve has been formed and the package produced, the yarn aspirated into the suction tube is cut off, and the cut-off yarn end is removed by suction through the suction nozzle when the bobbin in changed. In that method, a piece of yarn that has been clamped by the edge of the tube remains behind.

Published European Application No. 0 148 419 B, corresponding to U.S. Pat. No. 4,687,148, discloses an apparatus for forming a yarn reserve in which the yarn is first caught by a slit in a centering shoulder for holding the bobbin tube. The yarn is drawn onto the bottom of the catching slit and in that way travels between the edge of the tube on the end surface and the tube disk and is clamped in place there. The yarn is drawn into the tube by a relative motion between the tube and the bobbin disk. In that case the danger exists that the yarn between the bobbin disk and the end surface of the tube will be ground between the two because of their relative motion so that it will therefore be damaged.

In the yarn reserves known from the prior art, there is no assurance that the intended yarn reserve can be reliably produced or securely held in terms of its yarn length, its position on the tube end, and its safety during transport.

It is accordingly an object of the invention to provide a method and an apparatus for winding a yarn reserve, which overcomes the hereinafore-mentioned disadvantages of the heretofore-known devices and methods of this general type.

SUMMARY OF THE INVENTION

With the foregoing and other objects in view there is provided, in accordance with the invention, a method for winding a yarn reserve on a tube of a bobbin before a yarn package is wound, which comprises initially applying a piece of yarn on an end of a tube of a bobbin while leaving a free yarn end; covering and fixing the piece of yarn in place with a small number of yarn windings of a yarn reserve; and severing the free yarn end on the tube between the yarn reserve and the tube end while the bobbin is rotating.

Severing on the tube prevents a yarn end from protruding beyond the tube, where it could catch during transport, causing the yarn reserve to be paid out and leaving a dragging yarn end. Furthermore, this assures that a damaged piece of yarn that was squeezed between the end surface of the tube and the tube disk is not included in the yarn processing. Moreover, a precisely defined yarn length is always available in the yarn reserve as a result. The short end that protrudes from beneath the yarn windings of the yarn reserve is easily visible on the end of the tube that has no windings on it.

In accordance with another mode of the invention, there is provided a method which comprises aligning the piece of yarn covered by the windings of the yarn reserve substantially in the direction of the longitudinal axis of the tube and substantially at right angles to the windings of the yarn reserve, before the piece of yarn covered by the windings of the yarn reserve is severed. This assures that a precisely defined yarn length will always be available in the yarn reserve. A yarn cutter can be fed in a space-saving manner at right angles to the longitudinal axis of a tube, and the yarn can easily be cut by being aligned at right angles to the cutting edge.

With the objects of the invention in view, there is also provided an apparatus for winding a yarn reserve on a tube of a bobbin before a yarn package is wound, comprising a holder for a bobbin tube; a yarn transferring device for delivering a yarn to the tube; a drive for driving the tube while initially applying a piece of yarn on an end of the tube and leaving a free yarn end; a yarn guide for laying the yarn on the tube and covering and fixing the piece of yarn in place with a small number of yarn windings of a yarn reserve; and a yarn cutter for tripping a severing process by being fed toward the rotating tube and for severing the free end of the yarn on the tube between the yarn reserve and the tube end.

In accordance with another feature of the invention, in order to ensure that the yarn end will be grasped better, the yarn cutter is equipped with a device for grasping the thread and guiding it to the cutting position.

In accordance with a further feature of the invention, the device for grasping the thread can be made to contact the tube surface.

In accordance with an added feature of the invention, in order to prevent damage to the tube surface, there are provided means for preventing contact of the cutter with the surface of the tube.

In accordance with an additional feature of the invention, in order for the piece of yarn covered by the windings of the yarn reserve to assume the position intended according to the invention, there are provided means for monitoring the position of the tube in order to ascertain the location of the piece of yarn.

In accordance with yet another feature of the invention, the yarn cutter has knife-like cutting means.

In accordance with yet a further feature of the invention, the yarn cutter has disk-like rotatable cutting means.

In accordance with a concomitant feature of the invention, there is provided a positionable suction device, through which the free yarn end that is produced by the cutting can be removed by suction, so that it does not travel into the winding apparatus or the package and be wound there.

Other features which are considered as characteristic for the invention are set forth in the appended claims.

Although the invention is illustrated and described herein as embodied in a method and an apparatus for winding a yarn reserve, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 2 is a partly sectional, elevational view of a yarn catcher in the form of a catch finger on the tube disk;

FIG. 3 is a fragmentary elevational view showing the formation of a yarn reserve;

FIG. 5 is a fragmentary front-elevational view of the yarn cutter of FIG. 4, in the form of shears;

FIGS. 5*a* and 5*b* are fragmentary plan and elevational views showing details of the yarn cutter of FIG. 5;

FIG. 8 is a fragmentary elevational-view of a further version of a yarn cutter according to the invention, in the form of a knife;

FIGS. 8*a* and 8*b* are respective fragmentary front-elevational and plan views showing this yarn cutter, fed to a tube, upon cutting off the free end of the yarn;

FIG. 9 is a front-elevation view of a yarn cutter according to the invention with a rotatable cutting edge; and FIG. 9*a* is a plan view of the same yarn cutter.

DESCRIPTION OF THE PREFERRED EMBODIMENT

Figure 1:
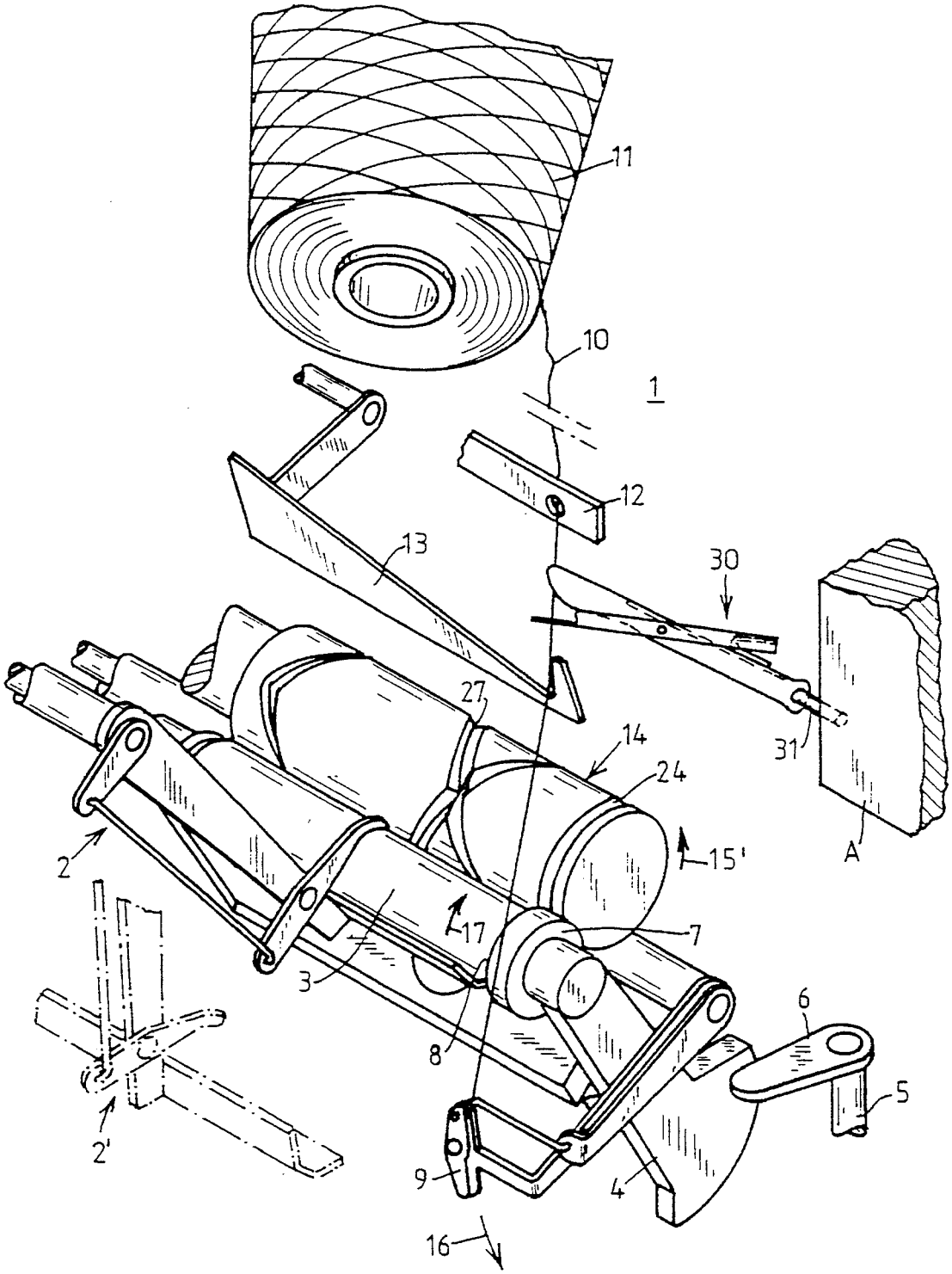
FIG. 1 is a fragmentary, diagrammatic, perspective view of a winding station or head with an apparatus for producing a yarn reserve when a tube is installed and for transferring the yarn.

Referring now to the figures of the drawing in detail and first, particularly, to FIG. 1 thereof, there is seen a winding station or winding head 1. Only the characteristics that contribute to an understanding the invention are shown and explained. One such winding station shown herein is known from German Published, Non-Prosecuted Application DE 25 06 291, corresponding to U.S. Pat. No. 4,154,411. It is installed in an open-end spinning machine for producing bobbin tubes with a reserve winding for the operation of starting spinning.

The transfer of a yarn to an empty bobbin tube and the formation of a yarn reserve will be explained below in conjunction with FIG. 1 and the ensuing drawing figures.

At the winding station 1, a tube gripper 2 has just placed an empty tube 3 into a bobbin creel. A bobbin creel arm 4 has been closed by a lever 6 that is rotatable about a shaft 5. A tube disk 7 is already in contact with a tube end 8 onto which a yarn reserve is to be wound.

A scissors clamp 9 holds a yarn 10 arriving from a feeding bobbin 11. The yarn 10 is guided by a guide 12 and a yarn lifter 13 which also performs the function of a yarn guide in the formation of the yarn reserve. Once the empty tube 3 has been released by the tube gripper 2 and the tube gripper has pivoted back into a position 2', the creel pivots the empty tube 3 against a winding drum 14, which rotates in the direction of an arrow 15'.

At the same time, the scissors clamp 9 is pivoted downward in the direction of an arrow 16, so that the yarn 10 enters the region of the tube disk 7 that is rotating with the empty tube 3. A direction of rotation 17 of the empty tube 3 and the tube disk 7 is counter to the direction of rotation 15' of the winding drum 14. The tube disk 7 is equipped with a catch finger 18, that is not shown in FIG. 1 but is shown in FIG. 2, which guides the yarn 10 into a yarn catching slit 19. As a result, the yarn 10 is carried along by the tube disk 7 and is wound onto the tube 3. At the moment when the yarn is engaged by the catch finger 18, the scissors clamp 9 releases the yarn.

The yarn 10 is carried along by the catch finger 18, travels into the catching slit 19, and is clamped in place between an end surface 20 of the tube 3 and the tube disk 7. The yarn 10 winds onto the tube 3, forming a yarn reserve.

This process is shown in FIG. 3 in its initial stage. The yarn 10, which has been transferred to the winding station 1 by the scissors clamp 9, has been caught by the catch finger 18. A free yarn end 21 can clearly be seen hanging sideways out of the catching slit 19 of the tube disk 7. Due to the position of the yarn lifter 13, a piece of yarn 22 that was first applied to the tube is deposited diagonally onto the tube 3 before a winding 23 is created. In order to enable the formation of a yarn reserve with parallel windings of the yarn on the tube, the winding drum 14 must be prevented from having any influence on the way in which the yarn is laid. In the region of the zone where the yarn reserve is formed, the winding drum 14 therefore has a recess, that is a wide groove 24, in which it does not contact the tube. During the formation of the yarn reserve, the piece of yarn 22 first applied to the tube is covered by the side-by-side windings 23 wound on top of it. To that end, the yarn lifter 13, which during this period also performs the function of a yarn guide, moves in the direction of an arrow 25. Once the formation of the yarn reserve has been completed, the yarn lifter 13 is rapidly retracted in the direction of an arrow 26 and is lowered at the same time, so that the yarn 10 travels into a yarn guide groove 27 of the winding drum, and from then on is deposited onto the tube 3 in crosswise layers.

Figure 4:
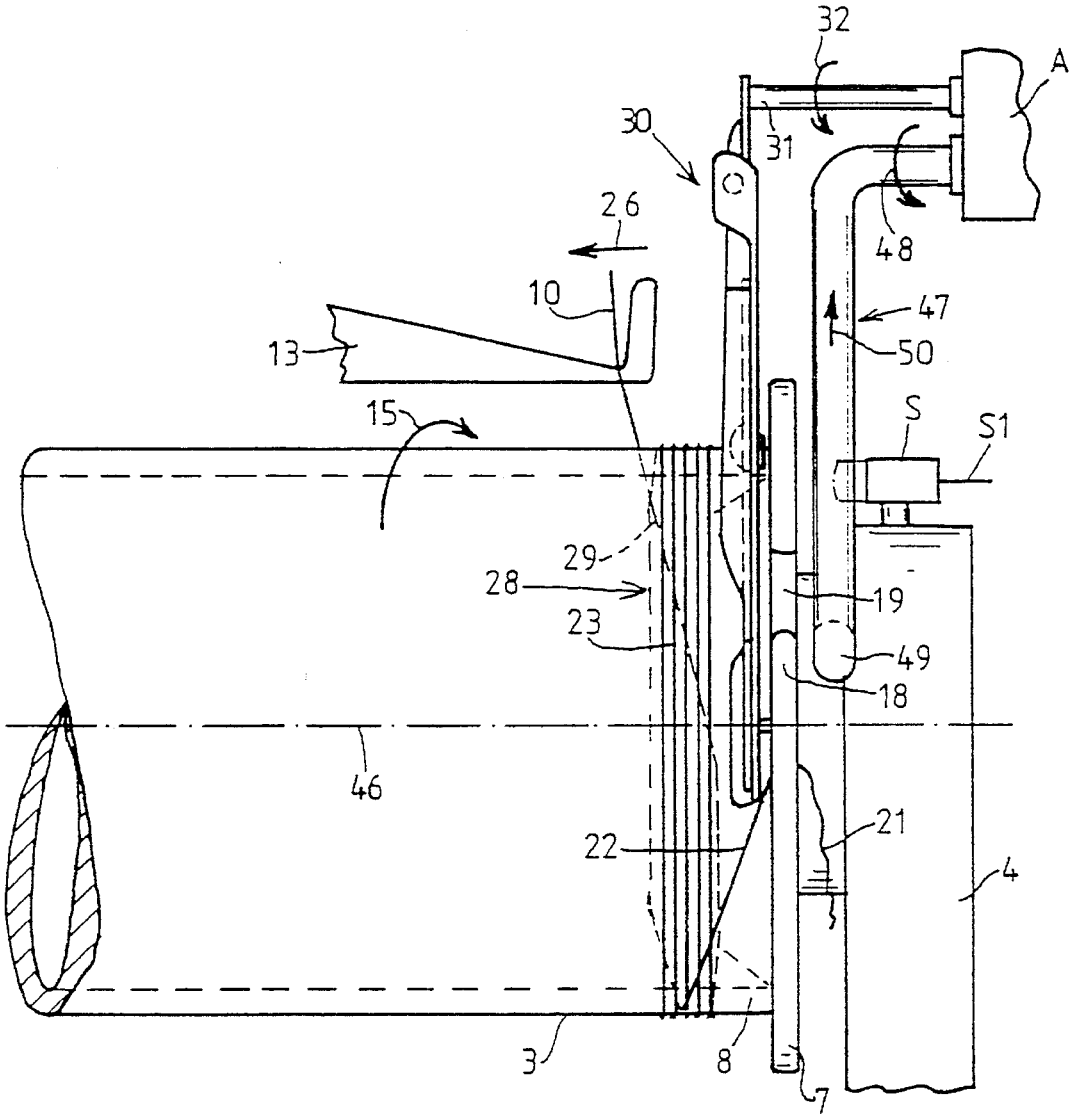
FIG. 4 is a fragmentary elevational view of a yarn cutter according to the invention, being fed to a tube.

FIG. 4 shows an enlarged portion of FIG. 3. A yarn reserve 28 has already been wound to completion on the tube 3. The yarn reserve 28 includes a small number of side-by-side yarn windings 23. In the present exemplary embodiment, these windings are five in number. The yarn lifter 13 has already migrated in the direction 26 into the region where the yarn guide groove 27 extends on the non-illustrated winding drum. In the process, it has guided the yarn 10 and deposited it in a diagonal winding 29 over the other yarn windings. Since this yarn winding has been deposited on the side of the spool facing away from the observer, it is shown in this case in dashed lines.

As can be seen from FIG. 4, a yarn cutter 30 according to the invention is fed to the tube. This version functions like scissors and is pivotable about a shaft 31. As is suggested in FIG. 1, the yarn cutter 30 is either installed at the winding station 1 itself or on a control unit A, which serves the various winding stations. The yarn cutter 30 has pivoted about its shaft 31 in the direction of an arrow 32 and thus has been fed or delivered to the tube 3. The yarn cutter 30 has a scissors-like construction, which will be explained in further detail in conjunction with FIGS. 5, 5*a* and 5*b*.

In order for the yarn reserve to be wound by the method according to the invention, the instant for cutting the free end 21 of the yarn is determined as follows: At the moment when the yarn 10 is fixed in place in such a way that it is carried along by the rotating tube, the tube assumes a certain position, which can be detected by a sensor either at the tube disk or on a device driving the tube, such as the winding drum, or can be defined by means of starting up a device for counting the revolutions. In the present exemplary embodiment of FIG. 4, a sensor S is located on the creel 4 and records the passage of the catching slit 19 past it. Signals are delivered over a signal line S1 to a non-illustrated control device which controls the drive of the winding drum 14 and the motion of the yarn lifter 13. For instance, if the yarn 10 has been engaged by the catch finger 18, then the catching slit 19 is moving past the sensor S at precisely that time. After one revolution of the tube disk, at the second time the catching slit 19 moves past the sensor S, the yarn lifter 13 begins to move in the direction 25 shown in FIG. 3, that is toward the yarn end 8, in order to deposit the windings 23 of the yarn reserve 28. The number of windings is fixed, and each winding corresponds to one passage of the catching slit 19 past the sensor S. Once the deposition of the last yarn winding has been completed, after a predetermined number of revolutions of the tube, which are counted by the passage of the catching slit 19 past the sensor S, the yarn lifter 13 moves in the direction 26 in order to transfer the yarn to the winding drum 14. At that moment, the yarn disk 7 is in a position in which it was located at the beginning of the formation of the yarn reserve, when the yarn 10 was grasped by the catch finger 18. In order to assure that the diagonally extending piece of yarn 22 applied to the tube first can be securely grasped by the yarn cutter 30, the yarn cutter 30 must be made to contact the tube 3 in the region of the tube end 8 next to the yarn reserve 28, once the final yarn winding 29 of the yarn reserve 28 has been wound in final fashion. This moment is shown in FIG. 4. The formation of a yarn reserve with a precisely defined number of windings has, for instance, likewise been described in German Published, Non-Prosecuted Application DE 37 33 353 A1.

Figure 6:
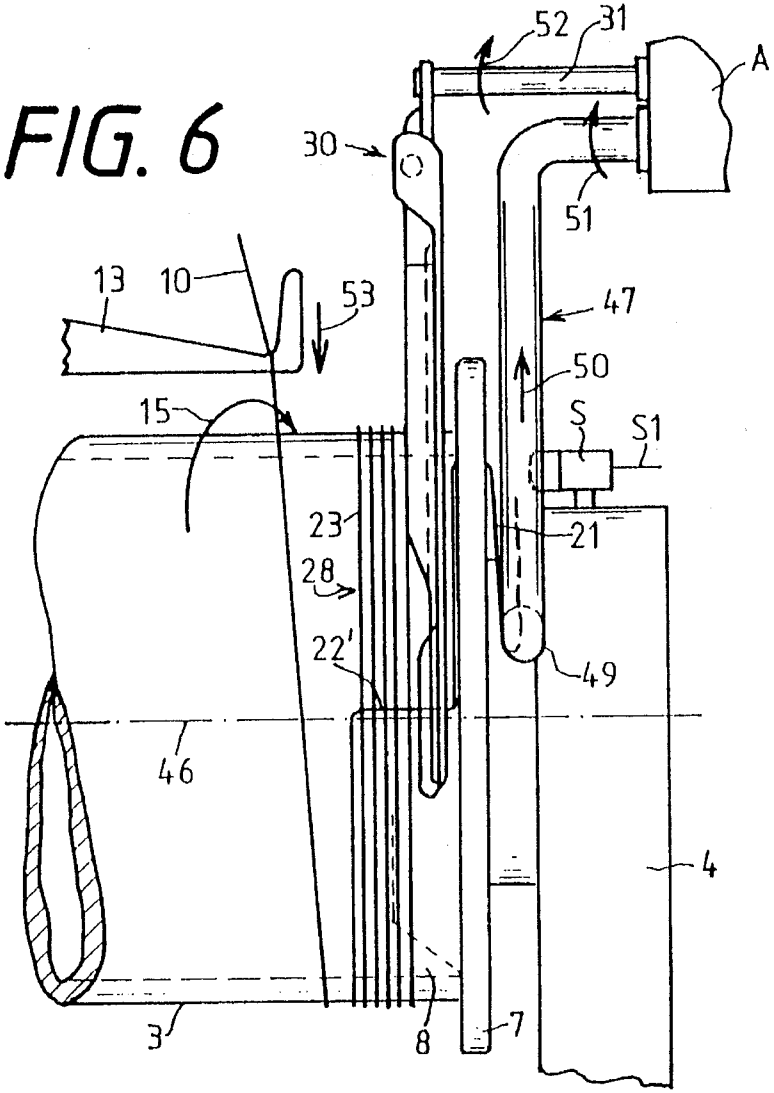
FIG. 6 is a fragmentary elevational view showing the yarn cutter of FIG. 5 upon severing the free end of the yarn.

If the tube 3 continues to rotate in the direction 15, then the piece of yarn 22 first applied to the tube, over which the windings 23 of the yarn reserve 28 have been wound, is engaged by the yarn cutter 30. According to the invention, in order to ensure that the piece of yarn 22 covered by the windings 23 of the yarn reserve 28 will be aligned substantially with a longitudinal axis 46 of the bobbin 3, substantially at right angles to the windings 23 of the yarn reserve 28, before the free end 21 of the yarn is severed, the tube 3 continues to rotate for one more revolution, which is monitored by the sensor S. As is claimed according to the invention, during this revolution, the piece of yarn 22 applied to the tube is first securely grasped and placed in a position 22' with respect to the longitudinal axis 46, which is a situation that is shown in FIG. 6. In order to prevent the free end 21 of the yarn from suddenly coming loose during the severing process and travelling into the yarn package or the winding station, a suction device 47 is delivered to the winding station 1, likewise at the moment when the yarn cutter is put into contact with the tube, as is already shown in FIG. 4. By way of example, the suction device 47 may be installed together with the yarn cutter on a control or work unit A which serves the winding stations as a servicing device. The suction device 47 has been pivoted in the direction of an arrow 48 in such a way that it comes to rest next to the tube disk 7, so that it can grasp the free end 21 of the yarn with a suction opening 49. Suction is applied, as indicated by an arrow 50, from the moment when the suction device 47 has been positioned.

In FIG. 6, the moment is shown in which the piece of yarn 22 first applied to the tube is in the location 22', which is substantially in the direction of the longitudinal axis 46 of the tube 3, and has been grasped by the yarn cutter 30. The free end 21 of the yarn has been engaged by the suction device 47 and has already been aspirated through the suction opening 49. Once the piece of yarn 22 in the location 22' is cut, the free end 21 of the yarn is aspirated and upon the suction device 47 pivoting backward in the direction of the arrow 51, it is drawn out of the catch slit 19, which is no longer visible in FIG. 6. Once the piece of yarn 22 in the position 22' has been cut, the yarn cutter also pivots back to its outset or initial position in the direction of the arrow 32. The yarn lifter 13 is in such a position that the yarn 10 can be transferred to the winding drum 14, which is not shown in. FIG. 6, in such a way that it enters the yarn guide groove 27 and is deposited on the bobbin in cross-wound layers. To that end, the yarn lifter 13 is lowered in the direction of the arrow 53.

Figure 7:
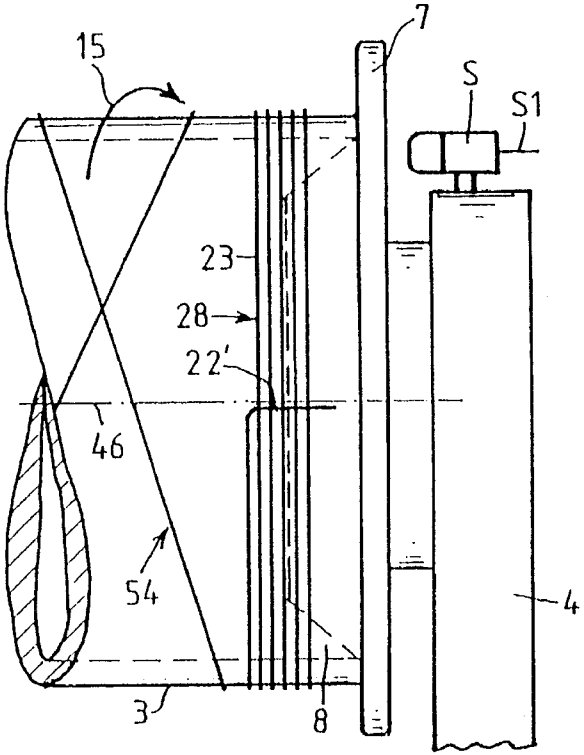
FIG. 7 is a fragmentary elevational view showing a yarn reserve formed by the method of the invention.

In FIG. 7, a yarn reserve according to the invention can be seen. Once the yarn cutter 30 and the suction device 47 have been pivoted back into their outset or initial positions, the formation of the yarn reserve is at an end. The free end 21 of the yarn is cut off, and the piece of yarn applied to the tube first is located in the position 22' and is aligned substantially at right angles to the windings 23 of the yarn reserve 28, which is substantially in the direction of the longitudinal axis 46 of the tube 3. The present yarn reserve has a precisely defined number of windings of yarn on the tube, and because of the location 22' of the piece of yarn as well as because of the cutting off of the free end of the yarn, a precisely defined length of the yarn reserve is present. As can be seen from FIG. 7, the winding drum has already begun to deposit the first cross-wound layers 54 of the yarn for building up the yarn package on the tube. The yarn cutter 30 will be described in further detail below in conjunction with FIGS. 5, 5*a* and 5*b*. The scissors-like yarn cutter 30 in the present exemplary embodiment includes three parts. The first part is a yarn receiver 33, in the form of a device for gripping and guiding the yarn. The yarn receiver 33 is joined in scissors-like fashion to a pivotable knife 34 at a point 35. By way of example, the pivotable knife 34 may be pivotably installed by mounting the shaft 31 thereof on the work unit A shown in FIGS. 4 and 6, for actuation. Through the use of a folded leaf spring 36, the two blades forming the scissors, that is the yarn receiver 33 and the pivotable knife 34, are kept open. On blade of the spring 36, which is in the form of a folded leaf spring, is secured with a rivet 38 to a part 37 of the yarn receiver 33, which is bent at a right angle. The other blade of the folded leaf spring 36 is supported on a part 39 of the pivotable knife 34 which is bent at a right angle, and it is secured with a rivet 40.

FIG. 5 shows part of the tube 3 in section. Through the use of its pivoting motion in the direction of the arrow 32, the yarn cutter 30 is made to contact the tube, which is rotating in the direction of the arrow 15. The yarn receiver 33 has a shoe 41 that receives the yarn and first contacts the tube surface. The shoe 41 is formed of a thin metal sheet, which is rounded at its tip and can thus slide under the yarn 22, as can be seen from FIG. 5. The shoe is constructed in such a way that it is resilient and can thus adapt to the curvature of the tube surface. The rotary motion in the direction 32 is continued until the shoe 41 presses with a slight pressure against the surface of the tube 3.

The front and plan views of FIGS. 5 and 5*a* show the way in which the yarn 22 is picked up by the shoe 41 because of the rotation of the tube 3 in the direction 15. First the yarn assumes a position 22*a* on the shoe 41. A catch edge 42 is created there as a means for gripping and guiding the yarn, but at this point the shoe 41 is bent at a right angle from the blade of the yarn receiver 33. The yarn can slide only as far as the position 22', until it contacts the catch edge 42. From then on, the yarn is necessarily restrained by the yarn receiver 33. The position of the yarn 22 before the yarn cutter 30 is shown in FIG. 4. The situation in which the yarn is located in the position 22' in FIG. 5 or 5*a* is shown in FIG. 6. The catch edge 42 accordingly makes it possible for the yarn piece 22 that is first applied to the tube to be aligned in a position substantially at right angles to the windings of the yarn reserve 28, that is substantially in the direction of the longitudinal axis 46 of the tube 3. It is not until that has taken place, which may be monitored by means of control over the position of the tube or tube disk, or in another version as is known from German Published, Non-Prosecuted Application DE-OS 37 33 353 A1, that the pivotable knife 34 is actuated. To that end, the shaft 31 is moved onward in the direction of rotation 32. The knife then moves downward counter to a spring force 43. A cutting edge 44 moves in the direction of the spring force 43 toward the shoe 41 and in so doing severs the yarn in the position 22'. The catch edge 42 prevents the yarn from slipping away as it is being cut. The shoe 41 is the means that prevents the cutting edge 44 from penetrating as far as the surface of the tube 3. This prevents damage to the tube surface.

Once the yarn cut has been made, the yarn cutter 30 is pivoted backward in a direction of rotation 45 and lifts away from the surface of the tube 3. In the process, the scissors formed by the yarn receiver and the knife opens as well. Any yarn residue that might be clamped therein, for example a residue of the free yarn end 21, is released as a result.

A further embodiment of the yarn cutter is shown in FIGS. 8, 8*a* and 8*b* and will be described in further detail below. The yarn cutter as shown in FIGS. 5, 5*a* and 5*b* has a scissors-like construction and serves to cut yarn that run toward the deployed yarn cutter, or in other words that are formed into the opened blades of the scissors, that is the pivotable knife 34 and the yarn receiver 33.

Conversely, the yarn receivers of FIGS. 8–9*a* are intended for applications in which the direction of rotation of the tube is the same as the direction in which the knife of the yarn cutter points. A decision as to which of the two embodiments will be employed, that of FIG. 5 or the versions of FIGS. 8 and 9, depends on the direction in which the tube rotates, where the yarn cutter 30 is disposed, and the side from which it can be fed against the tube.

A yarn cutter 55 as shown in FIGS. 8, 8*a* and 8*b* includes a pivotable knife 56, which is comparable to the pivotable knife 34 of the foregoing exemplary embodiment. This pivotable knife 56 is likewise seated on a shaft 57, which may lead to a non-illustrated work unit. Angle brackets 58*a* and 58*b* are each secured to a respective side of the haft or tang of the knife 56. These angle brackets 58*a* and 58*b* support a curved leaf spring 59. By way of example, the leaf spring 59 may be secured to the angle brackets with rivets 60. The fastening can be seen from the plan view of the yarn cutter 55 in FIG. 8*b*.

A cutting edge 61 of the knife extends through a slit 62 in the leaf spring 59, which is seen in FIG. 8*b*. A part 63 of the leaf spring 59 that is curved backward forms a shoe that is made to contact the surface of the tube 3. The shoe 63 is not split by the slit 62 and comes to an end in a rounded tip at the end of the leaf spring.

In the unactuated state, as is shown in FIG. 8, the shoe 63 is located somewhat below the cutting edge 61. If the yarn cutter 55 is made to contact the surface of a tube, then the leaf spring 59 yields, and the shoe 63 conforms to the surface of the tube. This is shown in FIG. 8*a*. In contrast to the foregoing exemplary embodiment, the tube 3 in this case rotates in a direction 64, which is the direction of the knife. The yarn winding 23 located on the surface of the tube 3 is picked up by the shoe 63 and taken to the position 22'. The yarn is thus caught by the upwardly bent leaf spring 59 and can no longer escape. The yarn is moved to a position in which it is aligned substantially at right angles to the windings 23 of the yarn reserve 28, or in other words essentially parallel to the longitudinal axis 46 of the tube 3. Through the use of a pivoting motion in a direction 65 about the pivot shaft 57, the knife 56 moves toward the surface of the tube 3. In the process, the yarn in the position 22' is severed. The shoe 63 serves as means for preventing the cutting edge 61 from contacting the surface of the tube 3. This precludes damage to the tube surface.

It can be seen from FIG. 8*b* that the side of the shoe 63 toward the yarn reserve 28 is narrower than the side toward the end surface 20 of the tube 8. This forms a constriction or reduction in size 67 that is intended to prevent the piece of yarn remaining on the tube after it has been severed from being carried along by the shoe 63 upon further rotation of the tube 3 and moved out of its desired position. As a result of the constriction, the carrying force is so slight that no disruption of yarn travel can occur.

Once the yarn cutter 55 has been actuated, the knife 56 pivots back about the pivot shaft 57 in the direction of an arrow 68. This lessens the pressure on the leaf spring 59, and after a sufficiently extended rotation about the pivot shaft 57, the yarn cutter 55, with its shoe 63, lifts all the way away from the surface of the bobbin 3.

FIGS. 9 and 9*a* show an exemplary embodiment of a yarn cutter that is comparable to the foregoing exemplary embodiment. However, a rotating cutting edge is used in this case instead of a fixed knife.

A yarn cutter 70 of FIGS. 9 and 9*a* includes a pivotable knife holder 71. The knife holder 71 is secured to a hollow shaft 72 that can lead to a non-illustrated work unit which can be delivered toward the applicable winding station. Angle brackets 73*a* and 73*b*, which are attached laterally on the knife holder 71, support a leaf spring 7 that is identical in structure to the leaf spring 59 of the foregoing exemplary embodiment. This leaf spring 74 may likewise be secured to the angle brackets 73*a*, 73*b* with rivets 75. Like the leaf spring 59, the leaf spring 74 has a backwardly curved shoe 76, which can be made to contact the surface of a tube. Once again, the leaf spring has a slit 77. A disk-shaped knife 78 reaches through this slit and is secured to the end of the knife holder in such a way that it is rotatable about a shaft 79. A small pulley 80 is located on the shaft 79, next to the disk-like knife 78. A small cord 81, for example, is wound about this pulley 80 and leads to a further pulley 82, which is seated on a shaft 83 that is guided centrally through the hollow shaft 72.

If the yarn cutter 70 is pivoted about its shaft 72 in the direction of an arrow 84 and fed toward a non-illustrated tube, then the shoe 76 presses against the surface of the tube 3. In the process the leaf spring 74 is deformed and lifted to a position 74', in the direction of the arrow 85 At the same time, the pulley 82 is set into motion through the shaft 83, as is indicated by an arrow 86. The pulley 82 drives the pulley 80 through the cord 81. This drives the disk-like knife 78 in a direction 87. A yarn caught by the shoe 76 is severed whenever the leaf spring 74 is in the position 74'. A driven knife is especially advantageous whenever the yarns are coarse or are made of synthetic fibers that are difficult to cut with a knife. Instead of a disk-like knife, a thin cutting disk which is, for example, made of a ceramic material, may also be used.

As in the foregoing exemplary embodiment, the shoe in this exemplary embodiment is also shaped in such a way that the side of the shoe toward the yarn layers has a constriction or area 88 of reduced size. Since the leaf spring and the shoe match the versions in the foregoing exemplary embodiment, the same advantages apply for this exemplary embodiment as for the foregoing exemplary embodiment.

We claim:

1. A method for winding a yarn reserve on a tube of a bobbin before a yarn package is wound, which comprises:

initially placing a piece of yarn on an end of a tube of a bobbin and leaving a free yarn end;

covering and fixing the piece of yarn in place with a small number of yarn windings of a yarn reserve; and severing the yarn at a severing position defined on the tube between the yarn reserve and the tube end while the bobbin is rotating.

2. The method according to claim 1, which comprises aligning the piece of yarn covered by the windings of the yarn reserve substantially in a direction of a longitudinal axis of the tube and substantially at right angles to the windings of the yarn reserve, before the severing step.

3. An apparatus for winding a yarn reserve on a tube of a bobbin before a yarn package is wound, comprising:

a holder for a bobbin tube;

a yarn transferring device for delivering a yarn to the tube;

a drive for driving the tube while initially applying a piece of yarn on an end of the tube and leaving a free yarn end;

a yarn guide for laying the yarn on the tube and covering and fixing the piece of yarn in place with a small number of yarn windings of a yarn reserve; and a yarn cutter for severing the yarn at a severing position defined between the yarn reserve and the tube end, said yarn cutter including means movably disposed for approaching the rotating tube and severing the yarn at the severing position.

4. The apparatus according to claim 3, wherein said yarn cutter includes a device for grasping the piece of yarn applied on the tube end and guiding it to the severing position.

5. The apparatus according to claim 4, wherein said device for grasping the piece of yarn contacts a surface of the tube.

6. The apparatus according to claim 3, wherein said yarn cutter includes cutting means and means for preventing said cutting means from contacting a surface of the tube.

7. The apparatus according to claim 3, including means for monitoring a position of the tube for ascertaining the position of the piece of yarn, and means for actuating said yarn cutter in dependence of the position of the piece of yarn covered by the windings of the yarn reserve.

8. The apparatus according to claim 3, wherein said yarn cutter has knife-like cutting means.

9. The apparatus according to claim 3, wherein said yarn cutter has disk-like, rotatable cutting means.

10. The apparatus according to claim 3, including a suction device for removal of the severed free end of the yarn by suction.

* * * * *